US007028506B2

(12) United States Patent
Kim et al.

(10) Patent No.: US 7,028,506 B2
(45) Date of Patent: Apr. 18, 2006

(54) INDOOR UNIT OF PACKAGED AIR CONDITIONER

(75) Inventors: Jeong-Hun Kim, Changwon-shi (KR); Sung-Man Hwang, Changwon-shi (KR); Yun-Seob Eom, Changwon-shi (KR); Jeong-Hwan Joo, Busankwangyeok-shi (KR); Seong-Hwa Lee, Changwon-shi (JP)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/450,203

(22) PCT Filed: Oct. 15, 2001

(86) PCT No.: PCT/KR01/01736

§ 371 (c)(1),
(2), (4) Date: Jun. 12, 2003

(87) PCT Pub. No.: WO03/033965

PCT Pub. Date: Apr. 24, 2003

(65) Prior Publication Data

US 2004/0035140 A1 Feb. 26, 2004

(51) Int. Cl.
*F25D 17/06* (2006.01)

(52) U.S. Cl. ..... 62/426; 62/512

(58) Field of Classification Search ..... 62/426–428, 62/512, 515; 454/232–236
See application file for complete search history.

(56) References Cited

U.S. PATENT DOCUMENTS

| | | | | | |
|---|---|---|---|---|---|
| 3,792,593 | A | * | 2/1974 | Loos et al. | 62/262 |
| 3,827,342 | A | * | 8/1974 | Hughes | 454/231 |
| 4,553,404 | A | * | 11/1985 | Malchow et al. | 62/262 |
| 4,738,188 | A | * | 4/1988 | Nishida | 454/229 |
| 5,415,526 | A | | 5/1995 | Mercadante et al. | 416/190 |
| 5,769,707 | A | * | 6/1998 | Jang et al. | 454/233 |
| 5,787,717 | A | | 8/1998 | Bang | 62/89 |
| 5,807,170 | A | | 9/1998 | Lee | 454/233 |
| 6,134,909 | A | * | 10/2000 | Lyu | 62/404 |
| 6,318,109 | B1 | * | 11/2001 | Reimann et al. | 62/317 |

* cited by examiner

*Primary Examiner*—Melvin Jones
(74) *Attorney, Agent, or Firm*—Fleshner & Kim, LLP

(57) ABSTRACT

Disclosed is an indoor unit of a packaged air conditioner including a cabinet having an inlet grill at a lower part and an outlet grill at an upper part so as to provide a circulation space of an indoor air, an evaporator established on a slant at an inner upper part of the cabinet to cool the indoor air with evaporation heat of a refrigerant, a cross-flow fan installed at an inner lower part of the cabinet to compulsorily inhale to exhale the indoor air toward the evaporator wherein the inhaled and exhaled indoor airs coexist at a same height, and a separator installed between a top of the cross-flow fan and the evaporator to prevent the inhaled and exhaled airs from intervening each other.

32 Claims, 8 Drawing Sheets

INDOOR UNIT OF PACKAGED AIR CONDITIONER

BACKGROUND OF THE INVENTION

1. Field of the Invention

The present invention relates to a packaged air conditioner, and more particularly, to an indoor unit of a packaged air conditioner enabling to reduce both power consumption and noise by decreasing a system resistance using a cross-flow fan as a ventilator sucking in an indoor air compulsorily and blowing it to an evaporator.

2. Discussion of the Related Art

In general, an air conditioner is one of air controlling devices for cooling and ventilation/purification of an air for the purpose of pleasant air conditioning of an indoor environment. Such air conditioners are divided into a built-in-one-body type in which parts constructing a cooling cycle are established on one unit and a separate type in which the parts are established on separate units. Instead, the air conditioners may be divided in accordance with the product features into a wall suspension type of which indoor unit is hung on a wall, a floor mounting type of which indoor unit is established on a floor, and a ceiling suspension type of which indoor unit is suspended at a ceiling or hidden away inside the ceiling.

A packaged air conditioner is a separate floor mounting type, which is mounted on a floor to cool down a relatively-large indoor space, as a widely-adopted air conditioner. Such a packaged air conditioner cools an indoor space in a following manner that: a refrigerant gas having been compressed by a compressor is liquefied by exchanging heat with an outdoor air in a condenser; and the refrigerant liquid having passed through an expansion valve experiences a heat exchange with an outdoor air in an evaporator. Thus, the indoor space is cooled down using an evaporation heat of the heat-exchanging refrigerant.

The packaged air conditioner is generally constructed with an outdoor unit having built-in compressor and condenser to compress and liquefy a refrigerant and an indoor unit having built-in evaporator and the like to evaporate the refrigerant.

A structure of the packaged air conditioner is explained schematically as follows by referring to the attached drawings.

FIG. 1A and FIG. 1B illustrate front and objective views of a general packaged air conditioner.

Referring to FIG. 1A and FIG. 1B, an indoor unit of a packaged air conditioner includes a case 1 having an inlet grill 2 at a lower front part and an outlet grill 3 at an upper front, an evaporator 4 established on the slant at an inner upper part of the case 1 to cool an indoor air, and a blower 10 installed under the evaporator 4 to compulsorily inhale to blow the indoor air to the evaporator 4.

The blower 10 is placed at a rear of the inlet grill 2 for a smooth inhaling of the indoor air. In this case, the blower 10 uses a centrifugal fan in general such as a sirocco fan. The sirocco fan 10 inhales an air in an axis direction and blows the inlet air in a radial direction, for which a rotary axis is installed in a width direction of the case 1. The sirocco fan 10 includes an impeller 11 comprising a plurality of blades of which ends are bent in a rotary direction, a scroll housing 12 surrounding a circumference of the impeller 11 so as to provide a flow path of a blown air, and a motor 15 coupled with the rotary axis of the impeller 11. In this case, an outlet of the scroll housing 12 is open toward the evaporator 4 upward.

In the above-constructed sirocco fan, the indoor air inhaled into an eye of the impeller 11 is blown in the radial direction of the impeller 11 by a rotary movement of the blades and then guided into the evaporator 4 through an outlet of the scroll housing 12.

A drain pan 5 collecting a condensate of water generated massively from a surface of the evaporator 4 during a cooling of the air is placed below the evaporator 4. And, a condensate outlet 5*a* connected to an additional drain pipe (not shown in the drawing) is formed at a lower part of the drain pan 5.

The above-constructed packaged air conditioner is operated provided that a temperature of an indoor air is below a set temperature or a user carries out a compulsory operation of applying a power to the sirocco fan 10. The operating sirocco fan inhales the indoor air through the inlet grill 2 in an axis direction of the sirocco fan 10 so as to blow the inhaled air to the evaporator through the outlet of the scroll housing 12. In this case, the indoor air is cooled down by endothermic effect of the refrigerant as passing through the evaporator 4 and then blown into the indoor through the outlet grill 3, thereby cooling down the indoor space.

Unfortunately, the sirocco fan used as a blower in the above packaged air conditioner brings about the following problems/disadvantages.

First, the sirocco fan 10 fails to provide massive airflow having a constant pressure due to the above-explained fluid path structure despite providing such advantages as low RPM(revolutions per minute), small volume and the like in comparison with other types.

Second, the above-explained flow path of the sirocco fan is improper for an indoor unit of a packaged air conditioner, thereby increasing a system resistance. Namely, the sirocco fan 10 has the flow path through which an air is inhaled in the axis direction of the impeller 11 and the air is blown in the radial direction. In order to blow the air toward the evaporator 4 over the sirocco fan 10 of the indoor unit of the packaged air conditioner, the scrolling housing 12 should guide the blown. Such a process inevitably generates a measurable resistance of the flow path of air. As a result, the resistance by the flow path brings about a considerable noise during operation as well as increases power consumption.

Such a problem is more serious in a packaged air conditioner using a 3-way inlet type. Namely, an indoor air inhaled through inlet grills established at a front and both edges between lateral sides of a case should experience considerable resistances of the path flow so as to be inhaled in an axis direction of a sirocco fan. Therefore, power consumption should increase in comparison with the same airflow as well as causing a considerable noise.

Third, there is a limit to reducing a total width of a system in the indoor unit of the packaged air conditioner according to the related art. Namely, the rotary axis of the impeller 11 is installed along a width direction of the case 1 due to a structural characteristic of the flow path as well as the motor 15 should be placed at one end of the rotary axis. Therefore, a width of the indoor unit of the packaged air conditioner according to the related art should depend on a length of the sirocco fan and a size of the motor 15. Unfortunately, there should be a limit to the length of the impeller of the sirocco fan to attain a predetermined airflow, which fails to make a thin case.

SUMMARY OF THE INVENTION

Accordingly, the present invention is directed to an indoor unit of a packaged air conditioner that substantially obviates one or more of the problems due to limitations and disadvantages of the related art.

An object of the present invention is to provide an indoor unit of a packaged air conditioner using a cross-flow fan as a blower inhaling an indoor air compulsorily and blowing the inhaled air toward an evaporator so as to be arranged properly, thereby enabling to reduce both noise and power consumption by decreasing a system resistance.

Another object of the present invention is to provide an indoor unit of a packaged air conditioner having a slim size by using a cross-flow fan as a blower.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, an indoor unit of a packaged air conditioner according to the present invention includes a cabinet having an inlet grill at a lower part and an outlet grill at an upper part so as to provide a circulation space of an indoor air, an evaporator established on a slant at an inner upper part of the cabinet to cool the indoor air with evaporation heat of a refrigerant, a cross-flow fan installed at an inner lower part of the cabinet to compulsorily inhale to exhale the indoor air toward the evaporator wherein the inhaled and exhaled indoor airs coexist at a same height, and a separator installed between a top of the cross-flow fan and the evaporator to prevent the inhaled and exhaled airs from intervening each other.

To further achieve these and other advantages and in accordance with the purpose of the present invention, an indoor unit of a packaged air conditioner includes a cabinet having an inlet grill at a lower part and an outlet grill at an upper part so as to provide a circulation space of an indoor air, an evaporator established on a slant behind the inlet grill inside the cabinet to cool the indoor air with evaporation heat of a refrigerant, and a cross-flow fan installed between the evaporator and outlet grill wherein a low pressure part inhaling the air having passed through the evaporator is formed at a lower part of the cross-flow fan and wherein a high pressure part exhaling the air toward the outlet grill is formed at an upper part of the cross-flow fan.

To further achieve these and other advantages and in accordance with the purpose of the present invention, an indoor unit of a packaged air conditioner includes a cabinet having an inlet grill at a lower part and an outlet grill at an upper part so as to provide a circulation space of an indoor air, an evaporator established on a slant behind the inlet grill inside the cabinet to cool the indoor air with evaporation heat of a refrigerant, and a cross-flow fan installed inside the cabinet behind the outlet grill wherein a low pressure part inhaling the air having passed through the evaporator is formed at a lower part of the cross-flow fan and wherein a high pressure part exhaling the air toward the outlet grill is formed behind the outlet grill.

Therefore, the indoor unit of a packaged air conditioner according to the present invention arranges a cross-flow fan as a blower producing a massive airflow having a constant pressure so as to minimize a system resistance, thereby enabling to reduce power consumption as well as a noise caused by an air flow. Moreover, the indoor unit of a packaged air conditioner according to the present invention enables to provide a slim size by installing an impeller in a width direction of a case.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1A:
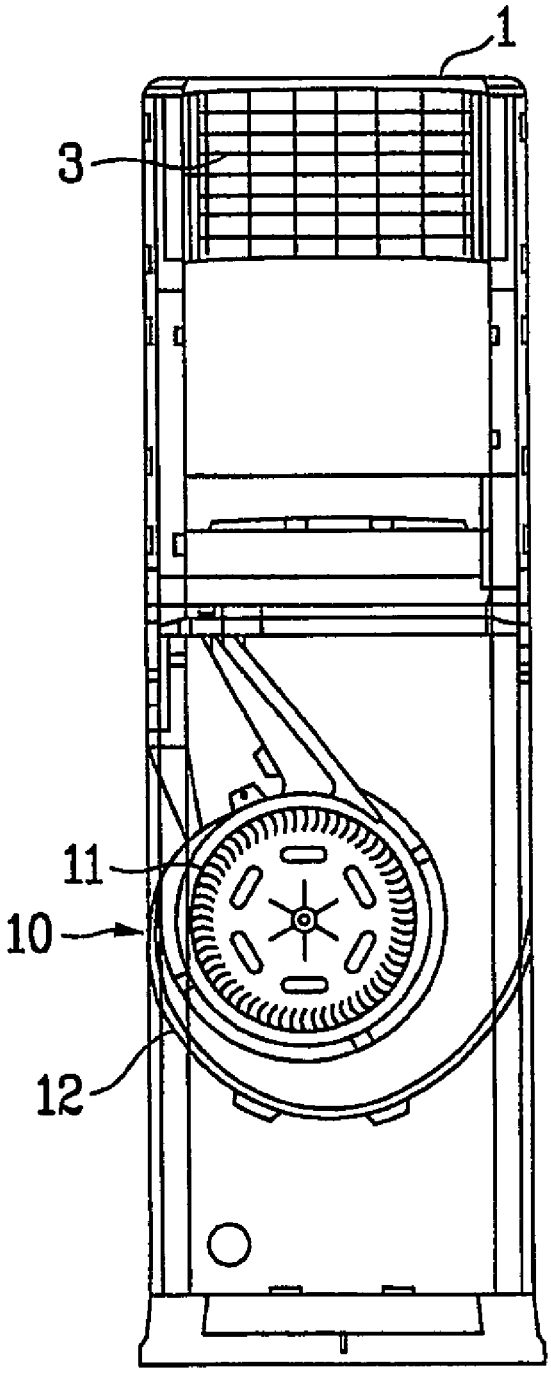
FIG.1A Prior Art
FIG. 1A and FIG. 1B illustrate front and objective views of a general packaged air conditioner.
Figure 1B:
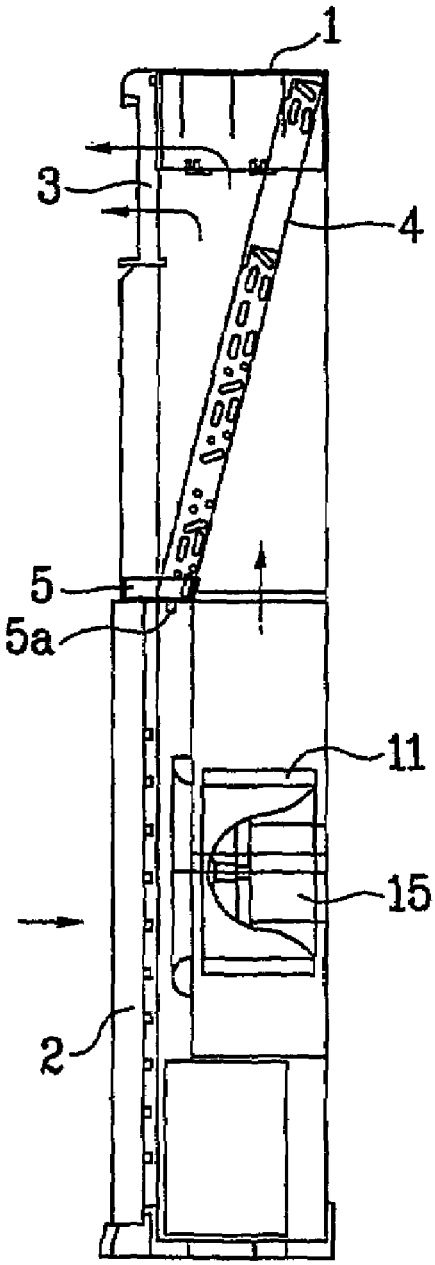
FIG.1B Prior Art

Reference will now be made in detail to the preferred embodiments of the present invention, examples of which are illustrated in the accompanying drawings. Where possible, the same reference numerals will be used to illustrate like elements throughout the specification.

Before describing the embodiments of the present invention, modifications and variations of indoor units of packaged air conditioners according to the present invention can be made in accordance with the arrangement of a cross-flow fan. Three representatives are described in the following preferred embodiments of the present invention.

First Embodiment

Figure 2A:
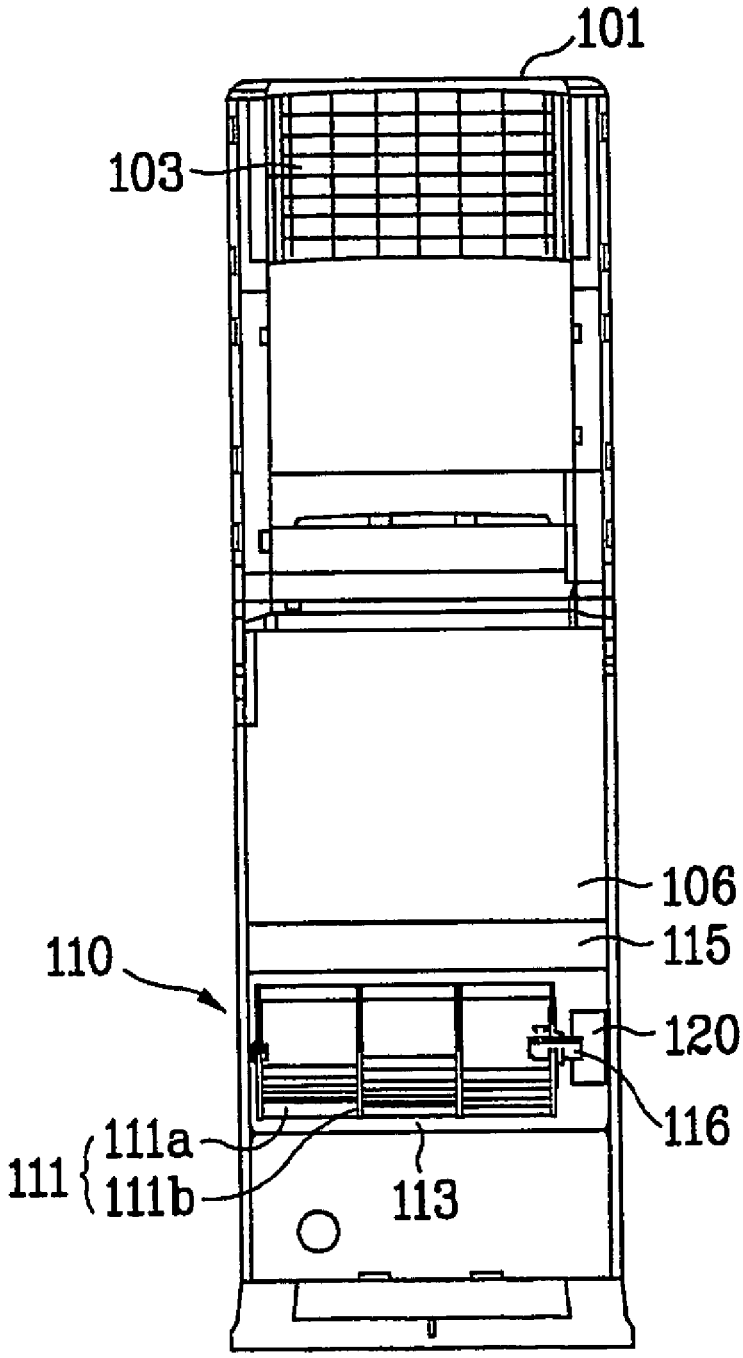
FIG. 2A and FIG. 2B illustrate front and objective views of an indoor unit of a packaged air conditioner according to a first embodiment of the present invention.
Figure 2B:
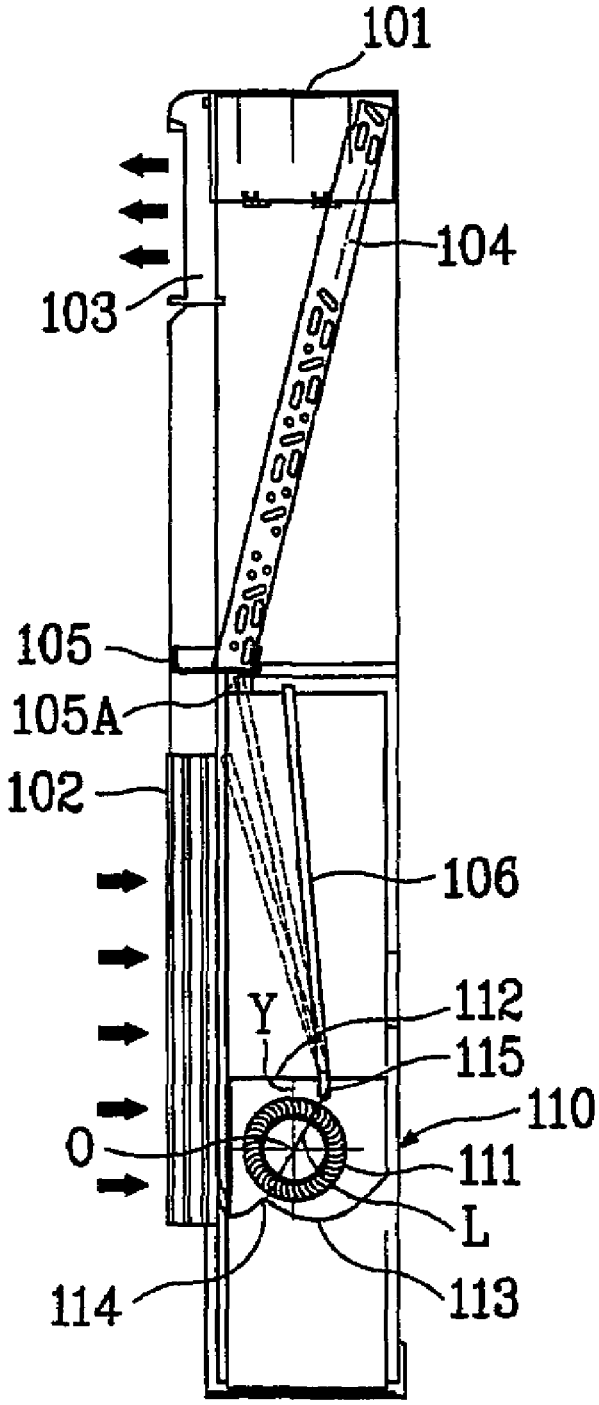

FIG. 2A and FIG. 2B illustrate front and objective views of an indoor unit of a packaged air conditioner according to a first embodiment of the present invention.

Referring to FIG. 2A and FIG. 2B, an indoor unit of a packaged air conditioner according to a first embodiment of the present invention includes a case 101 having an inlet grill 102 at a lower part and an outlet grill 103 at an upper part, an evaporator 104 established on the slant at an inner upper part of the case 101 to cool an indoor air with evaporation heat of a refrigerant, and a cross-flow fan 110 installed at an inner lower part of the case 101 to compulsorily inhale to blow the indoor air to the evaporator 104.

In this case, the indoor unit of the packaged air conditioner is a 3-way inlet type in which the inlet grill 102 is formed at a front and both side edges of the case 101. Besides, the inlet grill shown in FIG. 2B is formed at one side edge of the case 101.

The evaporator 104 is connected to a condenser of outdoor unit, compressor, and refrigerant pipe of an outdoor unit so as to construct a cooling cycle. And, upper and lower parts of the evaporator 104 are fixed to rear and front faces of the case 101 so as to be naturally installed on a slant.

A drain pan 105 collecting a condensate of water generated massively from a surface of the evaporator 104 during cooling the air is placed below the evaporator 104. And, a condensate outlet 105*a* connected to an additional drain pipe is formed at a lower part of the drain pan 105.

The cross-flow fan 110 includes an impeller 111 connected to an axis of a motor 120 to bring about air flux, a fan housing 112 established at an outer side of the impeller 111 to form a flow path of an air, and a stabilizer 115 installed at one side of the fan housing 112 along a length direction of the impeller 111 to establish a boundary between inlet and outlet airs. In this case, the impeller 111 is distinguished into multi-phases by a boundary plate and each of the phases is constructed with a plurality of blades inward-curved in a rotational direction. And, the fan housing 112 includes a rear guide 113 having a predetermined curvature to form an outlet flow path of an inlet air. Besides, a gap portion 114 is formed so as to have the shortest distance between one end of the rear guide 113 and the impeller 111, thereby forming the boundary between the inlet and outlet airs with the stabilizer 115.

The above-constructed cross-flow fan 110 generates inhalation and exhalation of air in a plane vertical to an axis of the impeller 111 instead of inhalation flow in an axis direction. The cross-flow fan 110 enables to produce a massive airflow at a constant pressure as well as with a uniform flow in the axis direction in general, thereby being fit for appliances such as air conditioning apparatus and the like. Yet, the cross-flow fan has never been applied to a packaged air conditioner but a window type air conditioner. This is because the cross-flow fan is improper for an indoor unit of the packaged air conditioner of which distance between inlet and outlet grills is considerably long owing to an airflow characteristic of the cross-flow fan. When the cross-flow fan is arranged improperly at the indoor unit of the packaged air conditioner, a system resistance increases so as to bring about power consumption and noise larger than those of the sirocco fan.

Considering these facts, the present invention arranges the cross-flow fan 110 so as to minimize a system resistance. Therefore, the present invention enables to overcome the above problems and improve the characteristics of the cross-flow fan.

In an indoor unit of a packaged air conditioner according to the first embodiment of the present invention, the cross-flow fan 110 is arranged so that an inhalation air inhaled through the inlet grill 102 coexists at the same height of an exhalation air blown toward the evaporator 104. Namely, an inhalation flow path of an indoor air inhaled to the cross-flow fan 110 and an exhalation flow path of the inhaled air blown toward the evaporator 104 from the cross-flow fan 110 are arranged in parallel each other at left and right, and vice versa, sides centering around an upper part of the cross-flow fan 110, respectively. Through such a flow path, the cross-flow fan 110 inhales the indoor air using the upper space and blows the inhaled air to the evaporator 104. In this case, the indoor unit further includes a separator 106 dividing the upper space so that the inhalation and exhalation airs do not intervene each other.

In order to provide the cross-flow fan 110 with the above-mentioned flow path structure, the impeller 111 is placed at a rear of the inlet grill 102 so that an axis direction of the impeller 111 is in parallel with a horizontal direction of the case 101, the rear guide 113 traverses a lower inside of the case below the impeller 111, and the stabilizer 115 is installed at one end of the upper part of the impeller 111.

In this case, the locations of the gap portion 114 at the rear guide 113 and the stabilizer 115 are very important factors in determining the flow path structure of the cross-flow fan 110. This is because inhalation and exhalation directions of air are decided by the locations of the gap portion 114 and stabilizer 115. Namely, a low pressure part inhaling an air and a high pressure part blowing the air are formed at both sides of a virtual line L connecting the gap portion 114 to the stabilizer 115 in accordance with a rotational direction of the impeller 111. Preferably, the inhalation and exhalation flow paths toward the cross-flow fan 110 and evaporator 104, respectively, are formed diffusible gradually.

Accordingly, in the cross-flow fan according to the present invention, the gap portion 114 of the rear guide 113 is placed at a front of a virtual vertical line Y passing through the rotational axis of the impeller 111, while the stabilizer 115 is placed at a rear of the vertical line Y.

Provided that the impeller 111 rotates counterclockwise, the low pressure part is formed at a front of the virtual line L connecting the gap portion 114 and stabilizer 115, while the high pressure part is formed at a rear of the virtual line L. Thus, the indoor air inhaled through the inlet grill 102 is naturally blown toward the evaporator 104. Moreover, the inhalation and exhalation flow paths at the front and rear centering around the stabilizer 115 respectively are formed diffusible gradually in accordance with a proceeding direction of air.

Meanwhile, the stabilizer 115 is one of major factors determining flow characteristics of the cross-flow fan. Namely, airflow, power consumption, and noise greatly depend on location and slope(inclination) of the stabilizer 15. The indoor unit of the packaged air conditioner according to the first embodiment of the present invention specifies the location and inclination of the stabilizer 115, thereby enabling to provide the most advantageous merits regarding the airflow, power consumption, and noise.

Figure 3:
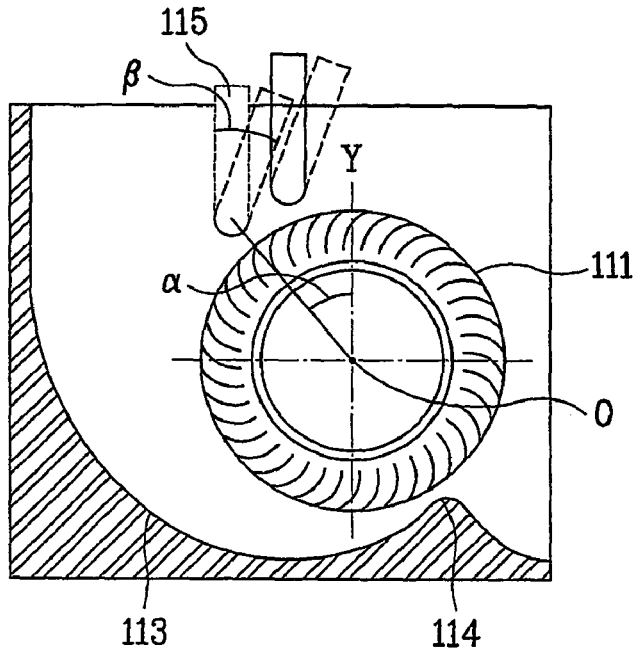
FIG. 3 illustrates a partial cross-sectional view of a cross-flow fan of the indoor unit in the packaged air conditioner according to the first embodiment of the present invention.
Figure 4:
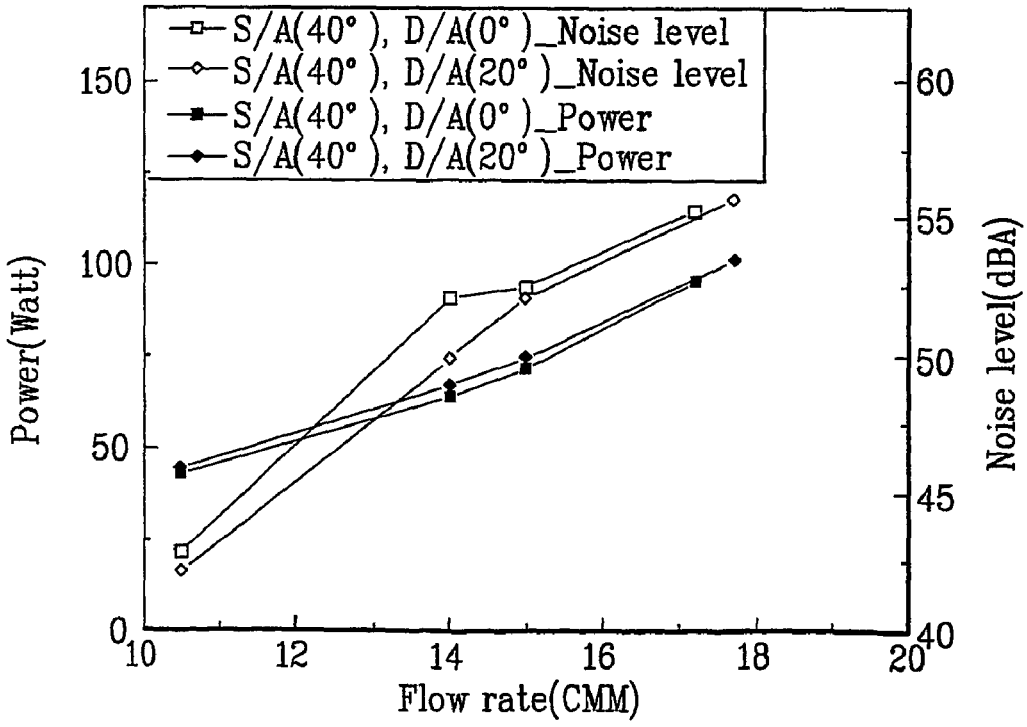
FIG. 4 illustrates a graph between power consumption and noise in accordance with installed locations of a stabilizer of the indoor unit in the packaged air conditioner according to the first embodiment of the present invention.

FIG. 3 illustrates a partial cross-sectional view of a cross-flow fan of the indoor unit in the packaged air conditioner according to the first embodiment of the present invention, and FIG. 4 illustrates a graph between power consumption and noise in accordance with installed locations of a stabilizer of the indoor unit in the packaged air conditioner according to the first embodiment of the present invention.

Referring to FIG. 3, several factors determining the locations and inclination of the stabilizer are explained as follows.

Let us assume that an angle between a lower end of the stabilizer 115 and the virtual vertical line Y passing through the rotational axis O of the impeller 111 is called a setting angle α and that the other angle determined by the inclination of the stabilizer 115 to the inlet grill (to the right direction in the drawing) is called a diffusing angle β. In this case, the setting angle α determines the setting location of the stabilizer 115, and the diffusing angle β determines how far the flow path, which is constructed with the stabilizer 115 and rear guide 113, of the blown air diffuses.

Thus, the present invention discloses the ranges of the setting angle of the stabilizer and the diffusing angle so that the cross-flow fan carries out its optimal performance. The setting angle α, as shown in FIG. 3A, determines the boundary between the inhalation and exhalation flow paths in parallel each other right and left in the drawing, whereby widths of the inhalation and exhalation flow paths depend on the range of the setting angle α. Namely, if the setting angle α is excessively large, the inhalation flow path expands but the exhalation flow path contracts. If the setting angle α becomes close to 0° (i.e. the stabilizer 115 is installed on an extending line of the virtual vertical line Y passing through the rotational axis O of the impeller 111), the inhalation flow path contracts but the exhalation flow path expands. Thus, the inhaled air may undergo a considerable resistance. Considering such a fact, the present invention defines the inhalation and exhalation flow paths enabling to minimize a flow path resistance by letting the setting angle α between 20° and 60°. When the setting angle α is set properly, the diffusing angle β determines diffusion flow paths of the inhaled and blown airs in parallel with each other. In this case, the present invention sets the diffusing angle β between 0° and 40°. When the diffusing angle β is 0°, the stabilizer 115 is placed in parallel with the virtual vertical line Y passing through the rotational axis of the impeller 111. When the diffusing angle β has a predetermined value, the stabilizer 115 is inclined to the inlet grill so that the exhalation and inhalation flow paths diffuse along a proceeding direction of air.

The present invention proposes values within the given ranges of the setting and diffusing angles so that optimal performance is attained. First of all, when the setting angle α is 40° as a middle value in the given range, a noise to the same airflow becomes minimized. Therefore, airflow, power consumption, and noise values are measured when the setting angle α is 40°, and the results follow.

TABLE 1

| α, β | Flow rate (CMM) | Rev. (rpm) | Power (Watt) | Noise (dBA) |
|---|---|---|---|---|
| 40°, 0° | 17.2 | 977 | 95.2 | 55.3 |
| | 15.0 | 858 | 71.4 | 52.5 |
| | 14.0 | 807 | 64.0 | 52.1 |
| | 10.6 | 633 | 43.1 | 42.9 |
| 40°, 20° | 17.7 | 940 | 100.9 | 55.7 |
| | 15.0 | 808 | 74.3 | 52.1 |
| | 14.0 | 752 | 66.9 | 49.9 |
| | 10.6 | 613 | 44.4 | 42.2 |

FIG. 4 represents the values in Table 1, where a horizontal axis indicates airflow, and left and right vertical axes represent power consumption and noise, respectively. A curve constructed with filled-squares ■ is a power consumption value when the setting and diffusing angles α and β are 40° and 0° respectively. A curve constructed with filled-lozenges ♦ is a power consumption value when the setting and diffusing angles α and β are 40° and 20° respectively. A curve constructed with vacant-squares □ is a noise value when the setting and diffusing angles α and β are 40° and 0° respectively. A curve constructed with vacant-lozenges ◇ is a noise value when the setting and diffusing angles α and β are 40° and 20° respectively.

Referring to FIG. 4, the power consumption is advantageous when the diffusing angle β of the stabilizer is 0°, while the noise is advantageous when the diffusing angle β of the stabilizer is 20°. For instance, the power consumption and noise are 71.4 Watt and 52.5 dBA when the airflow and diffusing angle β of the stabilizer are 15 CMM and 0°, respectively. Yet, the power consumption and noise are 74.3 Watt and 52.1 dBA when the diffusing angle β of the stabilizer is 20°. This means that the power consumption decreases but the noise somewhat increases provided that the diffusing angle of the stabilizer becomes reduced. In this case, the reason why the noise is reduced, when the diffusing angle β of the stabilizer is 20°, is that the flow path, which is constructed with the stabilizer 115 and rear guide 113, of the blown air naturally expands so as to reduce the flow path resistance.

Therefore, the diffusing angle of the stabilizer is determined in accordance with the purpose for reducing the noise or power consumption.

In this case, the present invention proposes the diffusing angle β of the stabilizer is one of 0° and 20°. Namely, the present invention enables to reduce the power consumption by setting the stabilizer 115 in parallel with the virtual vertical line Y passing through the rotational axis O of the impeller as well as suppress the generation of the noise by installing the stabilizer to be inclined toward the inlet grill at a predetermined angle.

Meanwhile, the separator 106, as shown in FIG. 2B, is established over the stabilizer 115 to prevent the inhaled and blown airs from intervening each other. The separator 106 is a panel type material dividing a space between a top of the stabilizer 115 and a bottom of the evaporator 104 into left and right parts respectively. Preferably, the separator 106 is formed somewhat inclined to the inlet grill 102 so that an upper part of the separator 106 is closer to the inlet grill 102 than a lower part of the separator 106. As the flow paths of the inhaled and blown airs are formed along the separator 106, it is preferable to form the flow paths along the proceeding direction of air.

In this case, it is preferable to form the separator 106 inclined at the same angle of the diffusing angle β of the stabilizer. The boundary, which is constructed with the separator 106 and stabilizer 115, between the inhaled and blown airs is formed smooth so as to help the progress of the air.

Besides, the separator 106 may be installed from the top of the stabilizer 115 to the drain pan 105 beneath the evaporator 104 or from the top of the stabilizer 115 to a top of the inlet grill 102. In this case, as the separator 106 is formed inclined smoothly, the inhaled and blown airs are separated from each other as well as have their own flow paths diffusing along their moving directions.

In the indoor unit of the packaged air conditioner according to the first embodiment of the present invention, an installment height of the cross-flow fan 110 depends on a distance between the evaporator 104 and cross-flow fan 110. Namely, if the distance between the evaporator 104 and cross-flow fan 110 is too close, the evaporator itself becomes an obstacle as a large flow path resistance. Therefore, considering such a distance, the cross-flow fan 110 should be installed so as to secure a sufficient distance between the evaporator 104 and cross-flow fan 110. In this case, it is unnecessary to place the inlet grill 102 to a bottom of the case 101. As the inhaled air is practically inhaled to the impeller 111 through an upper area over the rear guide 113, it is enough to place a bottom of the inlet grill 102 to an installment height of the rear guide 113.

Shown in Table 2 is a performance difference between the indoor unit of the packaged air conditioner according to the first embodiment of the present invention and the indoor unit having the sirocco fan according to the related art.

TABLE 2

| Type | Flow rate (CMM) | Rev. (rpm) | Power (Watt) |
|---|---|---|---|
| Sirocco Fan | 18.9 | 561 | 151.0 |
| | 15.2 | 461 | 121.9 |
| | 12.5 | 383 | 105.5 |
| Cross-flow Fan | 17.7 | 940 | 100.9 |
| | 15.0 | 808 | 74.3 |
| | 14.0 | 752 | 66.9 |
| | 10.6 | 613 | 44.4 |

Values shown in Table 2 are attained from experiments carried out in a manner that sirocco and cross-flow fans, which produce the similar airflow at the identical conditions, are replaced reciprocally. In this case, the setting and diffusing angles are established as 40° and 20°, respectively, and the separator is formed inclined to the same angle of the diffusing angle of the stabilizer.

Figure 5:
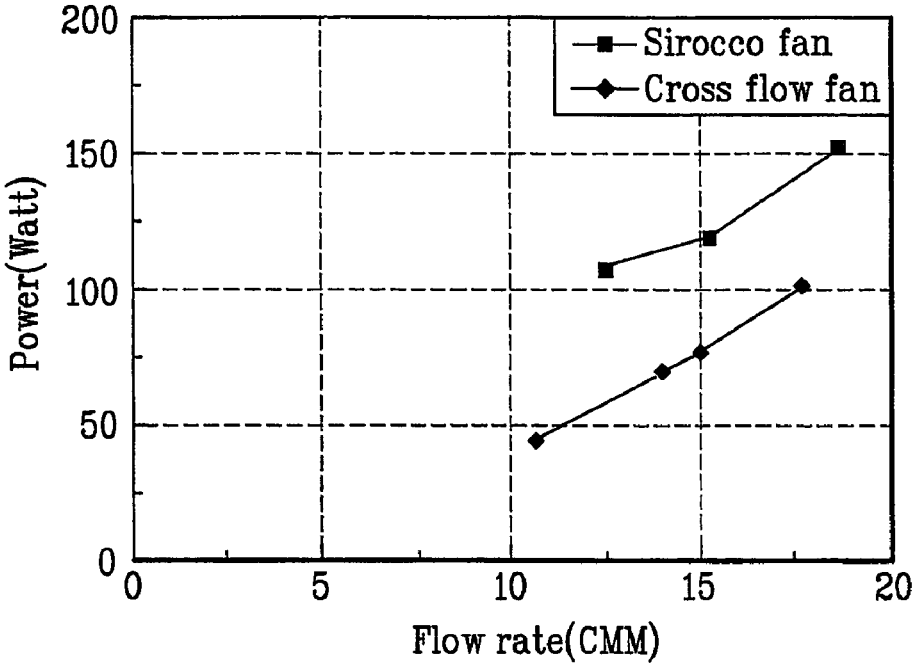
FIG. 5 illustrates a graph between airflows of the packaged air conditioner according to the first embodiment of the present invention and a conventional air conditioner using a sirocco fan.

FIG. 5 illustrates a graph between airflows of the packaged air conditioner according to the first embodiment of the present invention and a conventional air conditioner using a sirocco fan, which is based on the data in Table 2. In this case, a horizontal axis indicates airflow, and a vertical axis represents power consumption. A curve constructed with filled-squares ■ indicates power consumption of the sirocco fan, and the other curve constructed with filled-lozenges ♦ represents power consumption of the cross-flow fan.

Referring to Table 2 and FIG. 5, the indoor unit of the packaged air conditioner according to the present invention is superior to that according to the related art. For instance, the sirocco fan consumes a power of 121.9 Watt to produce an airflow of 15.2 CMM, while the cross-flow fan of the present invention consumes a power of 74.3 Watt only to produce an airflow of 15.0 CMM. This means that the indoor unit of the packaged air conditioner according to the present invention enables to produce the same airflow of the related art by consuming only 60% of the power required for the indoor unit of the related art using the sirocco fan. Namely, the indoor unit of the packaged air conditioner according to the present invention enables to produce an airflow much more than that of the related art does using the same power consumption, thereby enabling to increase a cooling efficiency considerably.

Such a result comes from a system resistance reduced by applying a cross-flow fan having an improved flow path structure to an indoor unit if a packaged air conditioner.

Figure 6:
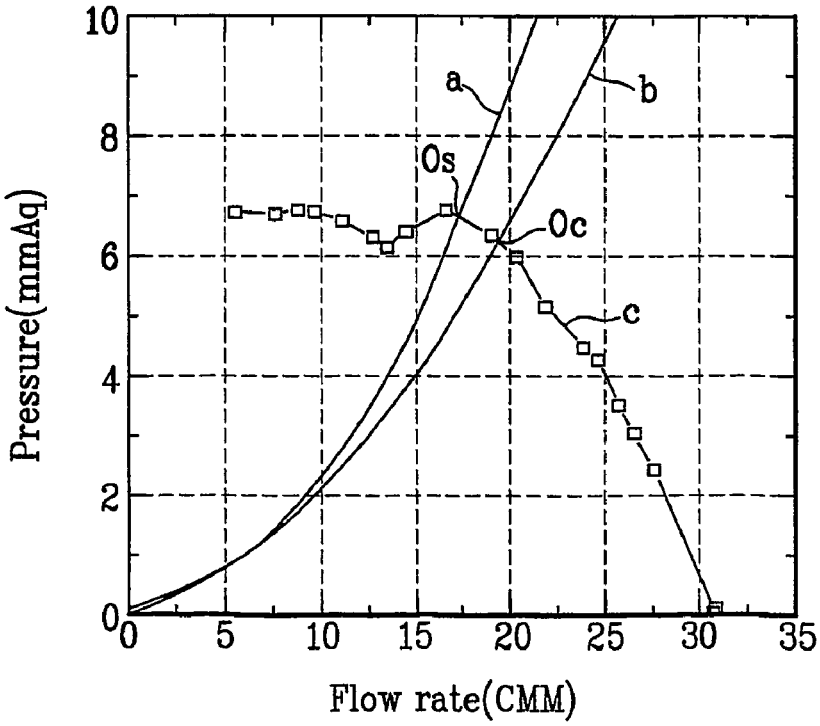
FIG. 6 illustrates a graph between system resistances of the packaged air conditioner according to the first embodiment of the present invention and a conventional air conditioner using a sirocco fan.

FIG. 6 illustrates a graph between system resistances of the packaged air conditioner according to the first embodiment of the present invention and a conventional air conditioner using a sirocco fan, where horizontal and vertical axes indicate airflow and static pressure, respectively. In this case of the graph, a curve a indicates a static pressure variation vs. airflow in a packaged air conditioner using a sirocco fan, a curve b does a static pressure variation vs. airflow in a packaged air conditioner using a cross-flow fan, and a curve c does a static pressure variation vs. airflow of a cross-flow fan disassembled from a system. Namely, the curve a indicates a system resistance of the packaged air conditioner using the sirocco fan, the curve b indicates a system resistance of the packaged air conditioner using the cross-flow fan, and the curve c does a single-item performance curve of the cross-flow fan.

In this case, points at which the curve c meets the curves a and b respectively are operating points. Namely, the point where the curve c meets the curve a is the operating point $O_S$ of the packaged air conditioner using the sirocco fan, and the other point where the curve c meets the curve b is the operating point $O_C$ of the packaged air conditioner using the cross-flow fan.

Referring to FIG. 6, the system resistance curve of the packaged air conditioner using the cross-flow fan is slower than that of the packaged air conditioner using the sirocco fan. Thus, the packaged air conditioner according to the present invention enables to produce airflow much more than that according to the related art at the same static pressure. Comparing the operating points $O_s$ and $O_c$ of both of the resistance curves, the static pressure of the packaged air conditioner using the cross-flow fan is lower than that of the packaged air conditioner using the sirocco fan despite having airflow larger than that of the packaged air conditioner using the sirocco fan. Therefore, the packaged air conditioner according to the present invention reduces its power consumption greatly.

So far, it has been described that the packaged air conditioner according to the first embodiment of the present invention consumes much less power than the related art using various experimental data. Meanwhile, although noise data attained by comparing the packaged air conditioners according to the present invention and related art fail to be disclosed, it will be apparent to those skilled in the art that the noise caused by the flow path resistance of air is remarkably reduced as well in the present invention using the cross-flow fan of which flow path structure is improved.

Moreover, as the cross-flow fan 110 is applied to the indoor unit of the packaged air conditioner according to the first embodiment of the present invention, variations and modifications can be made to designing an entire system. Namely, the impeller 111 of the cross-flow fan is installed along a horizontal direction of the case 101, thereby enabling to reduce a width of the system by decreasing a diameter of the impeller so as to manufacture a slimmer product. It is a matter of fact that the airflow may be reduced as the diameter of the impeller 111 is decreased. Yet, a sufficient length of the impeller compensates for such a loss of the airflow.

Second Embodiment

Figure 7:
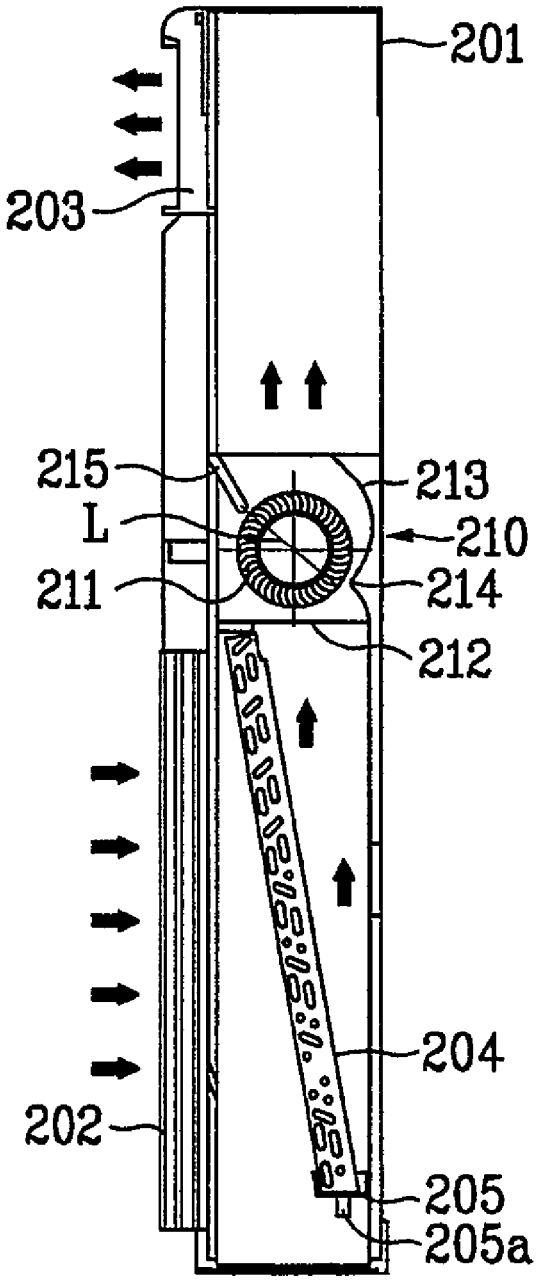
FIG. 7 illustrates an objective view of an indoor unit of a packaged air conditioner according to a second embodiment of the present invention.

FIG. 7 illustrates an objective view of an indoor unit of a packaged air conditioner according to a second embodiment of the present invention.

Referring to FIG. 7, an indoor unit of a packaged air conditioner according to a second embodiment of the present invention includes a case 201 having an inlet grill 202 at a lower part and an outlet grill 203 at an upper part, an evaporator 204 established on the slant at an inner upper part of the case 201 located at a rear of the inlet grill 202 to cool an indoor air with evaporation heat of a refrigerant, and a cross-flow fan 210 installed at an inner lower part of the case 201 between the evaporator 204 and outlet grill 203 to compulsorily inhale to blow the indoor air upward.

In this case, the indoor unit of the packaged air conditioner is a 3-way inlet type in which the inlet grill 202 is formed at a front and both side edges of the case 201. Besides, the inlet grill shown in FIG. 7 is formed at one side edge of the case 201.

The evaporator 204 is connected to a condenser of outdoor unit, compressor, and refrigerant pipe of an outdoor unit so as to construct a cooling cycle. And, upper and lower parts of the evaporator 204 are fixed to front and rear faces of the case 201 so as to be naturally installed on a slant.

A drain pan 205 collecting a condensate of water generated massively from a surface of the evaporator 204 during cooling the air is placed below the evaporator 204. And, a condensate outlet 205*a* connected to an additional drain pipe is formed at a lower part of the drain pan 205.

In this case, as the cross-flow fan 210 is installed between the evaporator 204 and outlet grill 203, low and high pressure parts of the cross-flow fan 210 should be formed at lower and higher parts of the cross-flow fan 210. For this configuration, the cross-flow fan 210 includes an impeller 211 placed horizontally between the evaporator 204 and outlet grill 203, a rear guide 213 placed at a rear of the impeller 211 and having a predetermined curvature to form an exhalation path of an inhaled air, and a stabilizer 215 installed over the impeller 211 to establish a boundary between inhaled and exhaled airs.

In the cross-flow fan 210, in order to form the high and low pressure parts at the above-mentioned locations, the stabilizer 215 should be placed over a front of a rotational axis of the impeller 211, and a gap portion 214 of the rear guide 214 should be located at a lower rear of the rotational axis of the impeller 211. In this case, the location and inclination of the stabilizer 215 are determined by selecting the proper setting and diffusing angles explained in the foregoing description.

Assuming that the impeller 211 rotates counterclockwise, the low and high pressure parts may be formed lower and upper parts of a virtual line L connecting the stabilizer 215 to the gap portion 214 of the rear guide 213. respectively.

Of course, the inhaled and exhaled airs are distinguished apparently centering around the cross-flow fan 210, thereby requiring no additional separator to separate arbitrarily the inhaled and exhaled airs from each other.

In aspect of power consumption, shown in Table 3 is a comparison between the indoor unit of the packaged air conditioner according to the second embodiment of the present invention and the indoor unit using the sirocco fan according to the related art.

TABLE 3

| Type | Flow rate (CMM) | Rev. (rpm) | Power (Watt) |
|---|---|---|---|
| Sirocco fan | 18.9 | 561 | 151.0 |
| | 15.2 | 461 | 121.9 |
| | 12.5 | 383 | 105.5 |
| Cross-flow fan | 11.3 | 1013 | 94.2 |
| | 10.6 | 932 | 77.1 |

Data shown in Table 3 are attained from experiments carried out in a manner that the sirocco fan and the cross-flow fan according to the second embodiment of the present invention, which produce the similar airflow at the identical conditions, are applied to the indoor units respectively.

Referring to Table 3, the cross-flow fan according to the second embodiment of the present invention has an RPM too high to produce the same airflow of the sirocco fan. Yet, the cross-flow fan enables to reduce its power consumption remarkably. For instance, the cross-flow fan according to the second embodiment of the present invention consumes a power of 94.2 Watt to produce an airflow of 11.3 CMM, while the sirocco fan according to the related art consumes a power of 105.5 Watt to produce an airflow of 12.5 CMM. Although failing to compare power consumption of the present invention to that of the related art, the cross-flow fan according to the second embodiment of the present invention enables to produce approximately the same airflow of the sirocco fan using similar power consumption.

Besides, the indoor unit of the packaged air conditioner according to the second embodiment of the present invention produces less airflow than the related art does, which is because the cross-flow fan itself becomes a flow path resistance against the inhaled air due to the close distance between the cross-flow fan 210 and evaporator 204. Considering such a fact, sufficient airflow is attained with less power consumption provided that the installment height of the cross-flow fan is set proper.

Third Embodiment

Figure 8:
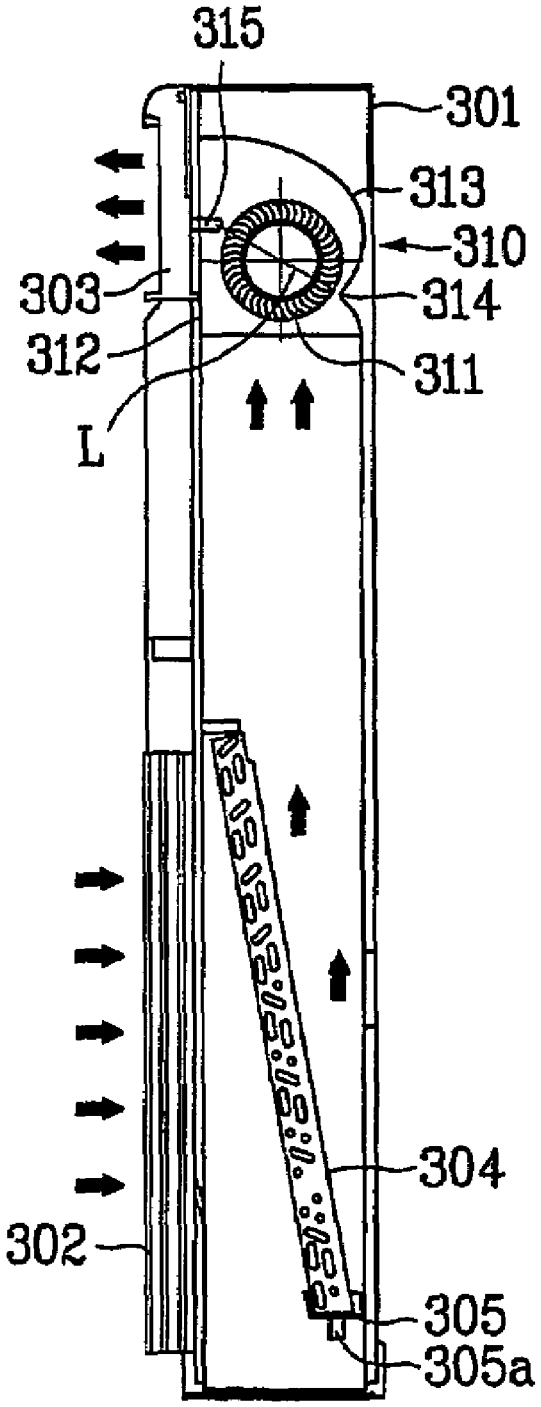
FIG. 8 illustrates an objective view of an indoor unit of a packaged air conditioner according to a third embodiment of the present invention.

FIG. 8 illustrates an objective view of an indoor unit of a packaged air conditioner according to a third embodiment of the present invention.

Referring to FIG. 8, an indoor unit of a packaged air conditioner according to a third embodiment of the present invention includes a case 301 having an inlet grill 302 at a lower part and an outlet grill 303 at an upper part, an evaporator 304 established on the slant at an inner upper part of the case 201 located at a rear of the inlet grill 302 to cool an indoor air with evaporation heat of a refrigerant, and a cross-flow fan 310 installed behind a rear of the outlet grill 303 to compulsorily inhale to blow the indoor air toward a side part confronting the outlet grill 303.

In this case, the indoor unit of the packaged air conditioner is a 3-way inlet type in which the inlet grill 302 is formed at a front and both side edges of the case 301. Besides, the inlet grill shown in FIG. 8 is formed at one side edge of the case 201.

The evaporator 304 is connected to a condenser of outdoor unit, compressor, and refrigerant pipe of an outdoor unit so as to construct a cooling cycle. And, upper and lower parts of the evaporator 304 are fixed to front and rear faces of the case 301 respectively so as to be naturally installed on a slant.

A drain pan 305 collecting a condensate of water generated massively from a surface of the evaporator 304 during cooling the air is placed below the evaporator 304. And, a condensate outlet 305*a* connected to an additional drain pipe is formed at a lower part of the drain pan 305.

In this case, as the cross-flow fan 310 is installed behind the outlet grill 303, low and high pressure parts of the cross-flow fan 310 should be formed at lower and higher parts of the cross-flow fan 310. For this configuration, the cross-flow fan 310 includes an impeller 311 placed horizontally behind the outlet grill 303, a rear guide 313 placed along a rear of the impeller 311 to the outlet grill 303 and having a predetermined curvature to form an exhalation path of an inhaled air, and a stabilizer 315 installed over the impeller 311 to establish a boundary between inhaled and exhaled airs.

In the cross-flow fan 310, in order to form the high and low pressure parts at the above-mentioned locations, the stabilizer 315 should be placed over a front of a rotational axis of the impeller 311, and a gap portion 314 of the rear guide 314 should be located at a lower rear of the rotational axis of the impeller 311. In this case, the installment height of the stabilizer is preferably set in parallel with a lower end of the outlet grill 303. Besides, the location and inclination of the stabilizer 315 are determined by selecting the proper setting and diffusing angles explained in the foregoing description.

Assuming that the impeller 311 rotates counterclockwise, the low and high pressure parts may be formed lower and upper parts of a virtual line L connecting the stabilizer 315 to the gap portion 314 of the rear guide 313, respectively.

Of course, the inhaled and exhaled airs are distinguished apparently centering around the cross-flow fan 310, thereby requiring no additional separator to separate arbitrarily the inhaled and exhaled airs from each other.

In aspect of power consumption, shown in Table 4 is a comparison between the indoor unit of the packaged air conditioner according to the third embodiment of the present invention and the indoor unit using the sirocco fan according to the related art.

TABLE 4

| Type | Flow rate (CMM) | Rev. (rpm) | Power (Watt) |
|---|---|---|---|
| Sirocco fan | 18.9 | 561 | 151.0 |
| | 15.2 | 461 | 121.9 |
| | 12.5 | 383 | 105.5 |
| Cross-flow fan | 15.5 | 910 | 103.1 |
| | 14.0 | 825 | 82.4 |

Data shown in Table 4 are attained from experiments carried out in a manner that sirocco fan and the cross-flow fan according to the third embodiment of the present invention, which produce the similar airflow at the identical conditions, are applied to the indoor units respectively.

Referring to Table 4, the cross-flow fan according to the third embodiment of the present invention consumes a power much less than the sirocco fan according to the related art does to produce the same airflow. For instance, the cross-flow fan according to the third embodiment of the present invention consumes a power of 103.1 Watt to produce an airflow of 15.5 CMM, while the sirocco fan according to the related art consumes a power of 121.9 Watt to produce an airflow of 15.2 CMM. Although failing to compare power consumption of the present invention to that of the related art, the cross-flow fan according to the third embodiment of the present invention enables to produce approximately the same airflow of the sirocco fan using similar power consumption. Namely, the packaged air conditioner according to the third embodiment of the present invention enables to produce an airflow much more than that of the related art does using the same power consumption, thereby enabling to increase a cooling efficiency considerably.

In the above description, indoor units of the packaged air conditioner according to the preferred embodiments of the present invention are described in detail by referring to the attached drawings. Therefore, the indoor unit of a packaged air conditioner according to the present invention arranges a cross-flow fan as a blower producing a massive airflow having a constant pressure so as to minimize a system resistance, thereby enabling to reduce power consumption as well as a noise caused by an air flow. Moreover, the indoor unit of a packaged air conditioner according to the present invention enables to provide a slim-sized system using characteristics of the cross-flow fan itself.

In aspects of airflow, power consumption, and noise of indoor units of packaged air conditioners according to the embodiments of the present invention, comparisons are made as follows.

TABLE 5

| Type | Flow rate (CMM) | Rev. (rpm) | Noise (dBA) | Power (Watt) |
|---|---|---|---|---|
| A | 15.0 | 808 | 52.1 | 74.3 |
| | 14.0 | 752 | 49.9 | 66.9 |
| B | 11.3 | 1013 | 55.7 | 94.2 |
| | 10.6 | 932 | 53.8 | 77.1 |
| C | 15.5 | 910 | 59.5 | 103.1 |
| | 14.0 | 825 | 56.6 | 82.4 |

In Table 5, types A, B, and C are the indoor units of the packaged air conditioners according to the first to third embodiments of the present invention, respectively. In this case, data for the respective items are measured values by arranging cross-flow fans and evaporators in the cases of the same size for the corresponding embodiments.

Referring to Table 5, the type B fails to produce the same airflow of the type A or C, thereby failing to compare the three types A, B, and C at the same airflow. Comparing the three types each other using similar airflow as references, the type A is superior to other types in aspects of power consumption and noise. For instance, the type A consumes a power of 66.9 Watt and brings about a noise of 49.9 dBA to produce an airflow of 14.0 CMM, the type B consumes a power of 94.2 Watt and brings about a noise of 55.7 dBA to produce an airflow of 11.3 CMM, and the type C consumes a power of 82.4 Watt and brings about a noise of 56.6 dBA to produce an airflow of 14.0 CMM.

Based on the above result, the indoor unit of the packaged air conditioner according to the first embodiment of the present invention is most advantageous in aspects of power consumption and noise. And, the indoor unit according to the third embodiment of the present invention is next to the first embodiment of the present invention. It is a matter of course that these three embodiments according to the present invention are superior to the related art using the sirocco fan in aspects of power consumption and noise.

Accordingly, the indoor unit of the packaged air conditioner using a cross-flow fan as a blower inhaling an indoor air compulsorily and blowing the inhaled air toward an evaporator so as to be arranged properly, thereby enabling to reduce both noise and power consumption by decreasing a system resistance as well as produce a sufficient airflow.

Moreover, the indoor unit of the packaged air conditioner according to the present invention enables to manufacture a slim-sized product using a cross-flow fan as a blower by designing a system variously.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

The invention claimed is:

1. An indoor unit of a packaged air conditioner, comprising:

a cabinet having an inlet grill positioned at a lower portion thereof, and an outlet grill positioned at an upper portion thereof so as to provide an air circulation space for air within the cabinet;

an evaporator positioned on a slant at an inner upper part of the cabinet and configured to cool the air;

a cross-flow fan installed at an inner lower section of the cabinet and configured to continuously inhale air, and to exhale the inhaled air toward the evaporator, wherein the inhaled and exhaled air occupy a same vertical position within the indoor unit;

a separator installed between a top of the cross-flow fan and the evaporator, and a stabilizer positioned at a lower end portion of the separator, wherein the separator and the stabilizer are configured to prevent the inhaled and exhaled air from intermixing.

2. The indoor unit of the packaged air conditioner of claim 1, wherein the cross-flow fan comprises:

an impeller positioned horizontally across the cabinet at a predetermined height behind the inlet grill; and a rear guide positioned below the impeller and having a predetermined curvature so as to form an exhalation flow path for the inhaled air, wherein the stabilizer is positioned between a top of the impeller and a bottom of the separator so as to form a boundary between the air inhaled into the impeller and the air exhaled from the impeller through the exhalation flow path.

3. The indoor unit of the packaged air conditioner of claim 2, wherein the stabilizer is positioned behind a first virtual line passing vertically through a rotational axis of the impeller, and wherein a gap portion of the rear guide is provided in front of the first virtual line.

4. The indoor unit of the packaged air conditioner of claim 3, wherein the cross-flow fan forms a low pressure part in front of a second virtual line connecting the gap portion of the rear guide and the stabilizer, and a high pressure part behind the second virtual line.

5. The indoor unit of the packaged air conditioner of claim 3, wherein a setting angle formed between a bottom of the stabilizer and the first virtual line passing vertically through the rotational axis of the impeller is between 20°~60°.

6. The indoor unit of the packaged air conditioner of claim 5, wherein the setting angle of the stabilizer is 40°.

7. The indoor unit of the packaged air conditioner of claim 5, wherein a diffusing angle formed by an inclination of the stabilizer relative to the inlet grill is between 0°~40°.

8. The indoor unit of the packaged air conditioner of claim 7, wherein the diffusing angle of the stabilizer is 20°.

9. The indoor unit of the packaged air conditioner of claim 7, wherein the separator is inclined at the same angle as the diffusing angle of the stabilizer so as to form a diffusing path for the exhaled air.

10. The indoor unit of the packaged air conditioner of claim 2, wherein the separator is installed on a slant extending from a top portion of the stabilizer to a drain pan positioned beneath the evaporator.

11. The indoor unit of the packaged air conditioner of claim 2, wherein the separator is installed on a slant extending from a top portion of the stabilizer to a top portion of the inlet grill.

12. The indoor unit of the packaged air conditioner of claim 1, wherein a bottom of the inlet grill is positioned on the cabinet at a height corresponding to the rear guide of the cross-flow fan.

13. An indoor unit of a packaged air conditioner, comprising:

a cabinet having an inlet grill positioned at a lower portion thereof, and an outlet grill positioned at an upper portion thereof so as to form an air circulation space for air within the cabinet;

an evaporator positioned on a slant at an inner upper part of the cabinet and configured to cool the air; and a cross-flow fan installed inside the cabinet and configured to continuously inhale air into the cabinet through the inlet grill, and to exhale the inhaled air toward the evaporator, wherein the cross-flow fan comprises an impeller positioned horizontally at a predetermined height behind the inlet grill, and a rear guide provided below the impeller so as to traverse an inside of the cabinet, wherein the rear guide has a predetermined curvature and is configured to form an exhalation flow path for the inhaled air, and a stabilizer positioned over an upper portion of the impeller between front and rear walls of the cabinet so as to form a boundary between air inhaled into and air exhaled from the impeller.

14. An indoor unit of a packaged air conditioner, comprising:

a cabinet comprising an inlet grill provided at a lower portion thereof and an outlet grill provided at an upper portion thereof so as to form an air circulation space for air within the cabinet;

an evaporator positioned on a slant inside the cabinet behind the inlet grill and configured to cool the air; and a cross-flow fan installed between the evaporator and outlet grill, wherein the cross-flow fan comprises an impeller and a stablizer configured to form a boundary between inhaled and exhaled air such that a low pressure portion is formed at a lower portion of the cross-flow fan, and a high pressure portion is formed at an upper portion of the cross-flow fan.

15. The indoor unit of the packaged air conditioner of claim 14, wherein the impeller is positioned horizontally in the cabinet between the evaporator and the outlet grill and the stabilizer is positioned over a front of the impeller so as to form a boundary between the inhaled air and the exhaled air, wherein the cross-flow fan further comprises a rear guide having a predetermined curvature positioned along a rear of the impeller so as to form an exhalation flow path for air inhaled through a gap portion provided below the rear of the impeller.

16. An indoor unit of a packaged air conditioner, comprising:

a cabinet comprising an inlet grill provided at a lower portion thereof and an outlet grill provided at an upper portion thereof so as to form an air circulation space for air within the cabinet;

an evaporator positioned on a slant inside the cabinet behind the inlet grill and configured to cool the air; and a cross-flow fan installed inside the cabinet proximate the outlet grill, wherein the cross-flow fan comprises an impeller and a stabilizer configured to form a boundary between inhaled and exhaled air such that a low pressure portion is formed at a lower portion of the cross-flow fan, and a high pressure portion is formed behind the outlet grill.

17. The indoor unit of the packaged air conditioner of claim 16, wherein the impeller is positioned horizontally in the cabinet behind the outlet grill, and the stabilizer is positioned in front of the impeller so as to form a boundary between the inhaled air and the exhaled air, wherein the cross-flow fan further comprises a rear guide having a predetermined curvature positioned along a rear portion of the impeller and extending to the outlet grill so as to form an exhalation flow path for air inhaled through a gap portion formed below a rear of the impeller.

18. The indoor unit of the packaged air conditioner of claim 1, wherein the inlet grill is positioned at a lower front portion of the cabinet, and wherein the outlet grill is positioned at an upper front portion of the cabinet.

19. The indoor unit of the packaged air conditioner of claim 18, wherein the inlet grill comprises a three-sided structure formed at a front and both side portions of the cabinet.

20. An air conditioner comprising the indoor unit of claim 1.

21. The indoor unit of the packaged air conditioner of claim 4, wherein the low pressure part is configured to inhale air into the cross-flow fan.

22. The indoor unit of the packaged air conditioner of claim 21, wherein the high pressure part is configured to direct the inhaled air towards the evaporator.

23. An air conditioner comprising the indoor unit of claim 13.

24. The indoor unit of the packaged air conditioner of claim 14, wherein the low pressure portion is configured to inhale air which has passed through the evaporator.

25. The indoor unit of the packaged air conditioner of claim 24, wherein the high pressure portion is configured to exhale air toward the outlet grill.

26. An air conditioner comprising the indoor unit of claim 14.

27. The indoor unit of the packaged air conditioner of claim 16, wherein the low pressure portion is configured to inhale air which has passed through the evaporator.

28. The indoor unit of the packaged air conditioner of claim 27, wherein the high pressure portion is configured to exhale air toward the outlet grill.

29. An air conditioner comprising the indoor unit of claim 16.

30. The indoor unit of the packaged air conditioned of claim 1, wherein the inlet grill is positioned at a lower front and side face of the cabinet.

31. The indoor unit of the packaged air conditioner of claim 1, wherein the outlet grill is positioned at an upper front face of the cabinet.

32. The indoor unit of the packaged air conditioner of claim 1 wherein the separator is positioned at an incline relative to the cabinet, and wherein a position of the separator is variable based on a position of the cross-flow fan relative to the cabinet.

* * * * *